US009005088B2

(12) United States Patent
Sides, Jr.

(10) Patent No.: US 9,005,088 B2
(45) Date of Patent: Apr. 14, 2015

(54) BARBELL ASSEMBLY HAVING IMPACT ABSORBING WEIGHTS AND SWIVEL END

(71) Applicant: Richard D. Sides, Jr., Lincolnton, NC (US)

(72) Inventor: Richard D. Sides, Jr., Lincolnton, NC (US)

( * ) Notice: Subject to any disclaimer, the term of this patent is extended or adjusted under 35 U.S.C. 154(b) by 0 days.

(21) Appl. No.: 14/227,696

(22) Filed: Mar. 27, 2014

(65) Prior Publication Data

US 2014/0200119 A1 Jul. 17, 2014

Related U.S. Application Data

(63) Continuation-in-part of application No. 14/071,632, filed on Nov. 4, 2013, which is a continuation-in-part of application No. 13/707,749, filed on Dec. 7, 2012, now abandoned.

(51) Int. Cl.

| | |
|---|---|
| ***A63B 21/072*** | (2006.01) |
| ***A63B 21/075*** | (2006.01) |
| ***A63B 21/06*** | (2006.01) |
| ***A63B 21/00*** | (2006.01) |
| ***A63B 23/04*** | (2006.01) |

(52) U.S. Cl.

CPC ..... *A63B 21/0724* (2013.01); *A63B 21/0618* (2013.01); *A63B 21/1411* (2013.01); *A63B 23/047* (2013.01); *A63B 2225/72* (2013.01)

(58) Field of Classification Search

CPC ..... A63B 21/072; A63B 21/0724; A63B 21/0726; A63B 21/0728; A63B 21/075; A63B 22/20; A63B 22/201; A63B 22/203; A63B 22/205; A63B 2021/072

USPC ..... 482/44–50, 74, 91–94, 97, 98, 482/104–113, 120, 131, 132; 280/1.5, 3

See application file for complete search history.

(56) References Cited

U.S. PATENT DOCUMENTS

| | | | | |
|---|---|---|---|---|
| 2,821,394 | A * | 1/1958 | Barbeau | 482/132 |
| 3,572,702 | A | 3/1971 | Dorn | |
| 4,361,324 | A * | 11/1982 | Baroi | 482/108 |
| 4,453,710 | A | 6/1984 | Plotz | |
| 4,775,147 | A * | 10/1988 | Bold, Jr. | 482/132 |
| 5,078,392 | A * | 1/1992 | Kracht | 482/107 |

(Continued)

OTHER PUBLICATIONS

Mehdi, How to make your own bumper plates on a budget, May 22, 2011, <http://web.archive.org/web/20110522050616/http://straight-tothebar.com/articles/2007/09/how_to_make_your_own_bumper_pl/ >.*

*Primary Examiner* — Stephen Crow
*Assistant Examiner* — Gregory Winter
(74) *Attorney, Agent, or Firm* — Christopher C. Dremann

(57) ABSTRACT

A barbell assembly includes a bar and a weight subassembly adjacent each end of the bar. Each weight subassembly includes a wheel with a predetermined pattern of through holes and an inflatable component around the periphery of the wheel. A hub defines a flange having a plurality of through holes corresponding to the through holes on the wheel for securing the wheel to the hub with fasteners. The hub is secured to the bar with fasteners, or the flange is secured to the bar by welding or with fasteners. An outer end of the bar is provided with a U-shaped swivel having a hook that rotates freely relative to the outer end and the grip portion of the bar. The barbell assembly may be utilized to perform weight training exercises without causing damage to an exercise surface, and may be locked to an immovable fixture using a tether and a lock.

18 Claims, 13 Drawing Sheets

(56) References Cited

U.S. PATENT DOCUMENTS

| | | | | |
|---|---|---|---|---|
| 5,197,931 | A * | 3/1993 | Wroclawsky | 482/74 |
| 5,509,877 | A * | 4/1996 | Adams | 482/108 |
| 5,921,900 | A * | 7/1999 | Mankovitz | 482/121 |
| 5,967,952 | A * | 10/1999 | Bronstein et al. | 482/111 |
| 6,203,476 | B1 * | 3/2001 | Wang et al. | 482/121 |
| 6,592,499 | B2 * | 7/2003 | Parker | 482/106 |
| D483,083 | S | 12/2003 | Allshouse et al. | |
| 7,048,678 | B2 * | 5/2006 | Harms et al. | 482/107 |
| 7,207,929 | B2 | 4/2007 | Hamilton | |
| 7,300,389 | B2 | 11/2007 | Lien et al. | |
| 7,387,599 | B1 * | 6/2008 | Hsu | 482/132 |
| 7,654,939 | B1 * | 2/2010 | Lin | 482/93 |
| 7,837,603 | B1 * | 11/2010 | Carnell, Sr. | 482/132 |
| 8,033,964 | B1 * | 10/2011 | Chen | 482/106 |
| 2006/0281608 | A1 * | 12/2006 | Tumminello | 482/93 |
| 2007/0010384 | A1 * | 1/2007 | Roberts | 482/140 |
| 2010/0267533 | A1 * | 10/2010 | Susnjara | 482/142 |
| 2011/0009247 | A1 | 1/2011 | Januszek | |

* cited by examiner

BARBELL ASSEMBLY HAVING IMPACT ABSORBING WEIGHTS AND SWIVEL END

CROSS-REFERENCE TO RELATED APPLICATION

This application is a continuation-in-part of U.S. application Ser. No. 14/071,632, filed on Nov. 4, 2013, which in turn is a continuation-in-part of U.S. application Ser. No. 13/707,749, filed on Dec. 7, 2012, the entire disclosures of which are incorporated herein by reference.

FIELD OF THE INVENTION

The invention relates generally to a barbell assembly, and more particularly, to a barbell assembly having impact absorbing weights mounted on a bar and a swivel adjacent at least one end of the bar. A barbell assembly constructed in accordance with the present invention can be used on any exercise or competition surface in any location without damaging the surface in the event the barbell assembly is dropped, while reducing noise and providing increased safety to the user. In addition, a barbell assembly constructed in accordance with the present invention can be used to perform weight training exercises that cannot be performed with a conventional barbell and conventional weights.

BACKGROUND OF THE INVENTION

Barbell assemblies are well known for performing strength and conditioning exercises, as well as for participating in weight-lifting, power-lifting and strong man competitions. Traditional barbell assemblies consist of an elongate bar and one or more free weights adapted to be mounted adjacent each of the opposite ends of the bar and retained on the bar by a retaining device, such as a removable collar. The bar is typically made of high-strength metal, for example steel, and the free weights are made of a heavy, dense material, such as metal (e.g. steel or pig iron). In some instances, the free weights are encased, covered or coated with a softer material, such as rubber or plastic, to reduce the amount of noise and damage that occurs when the barbell assembly or one of the free weights is dropped onto the exercise or competition surface. Depending on the type of surface, it is also possible that the bar and/or the free weights can be damaged from the impact with the exercise or competition surface.

Many different exercise or competition surfaces can be used with a barbell assembly. Typically, the surface is a substantially firm, rigid floor, for example wood, concrete or asphalt. In many instances, the floor is covered by a mat made of a softer, more energy-absorbing material, such as padded foam or rubber. The mat absorbs some of the impact caused by dropping the barbell assembly or the free weights onto the surface and reduces the noise that results from the weights striking the surface. However, the mat only protects the area of the surface covered by the mat. Accordingly, the surface and the barbell assembly is not protected from damage in the event that the barbell assembly or one of the free weights is dropped on a portion of the surface that is not covered by the mat. Furthermore, the mat does not protect the user from being struck by the heavy free weights, and therefore, does not increase the safety of the user.

United States Patent Application Publication No. US 2011/0009247 A1 published on Jan. 13, 2011, to Richard Zdzislaw Januszek discloses an exercise device weight for mounting to a lifting bar, such as a barbell or dumbbell. The exercise device weight has an inner weight section formed from cast iron and an outer skin formed from polyurethane or rubber material molded about the inner weight section. A plurality of relatively resilient raised surface features project outwardly from the outer skin to define a relief pattern on the circumferential outer surface of the outer skin. The resilient raised projections improve the impact absorption properties of the outer skin, and in particular, act to absorb impact energy and increase deceleration time during impact, thereby providing a softer impact and reducing damage to the exercise device and to other equipment.

U.S. Pat. No. 3,572,702 issued Mar. 30, 1971, to Harry M. Dorn discloses a hollow barbell weight made of an inexpensive, easily molded synthetic material, such as plastic, and provided with a fill opening. The hollow weight is filled with relatively inexpensive and heavy fill material, such as sand, cement, gravel or the like, and the fill opening is closed with a plug. Oftentimes, the plug is dislodged during use and the fill opening is compromised. As a result, the fill material leaks from the opening making the barbell or dumbbell unusable. To protect the weight, and in particular to prevent the plug from coming out, a band of rubber, foamed plastic or other stretchable material is provided that can be expanded to cover the outer circumference of the weight and then permitted to contract so as to firmly engage around the outer periphery of the weight. The band of rubber or like material protects the weight from impact failure in the event the weight is dropped, and physically holds the plug in place over the fill opening.

The aforementioned exercise weights for barbells and dumbbells are intended to protect the weight from impact damage caused, for example, by dropping the weight onto an exercise or competition surface. However, the resilient raised projections of the Januszek exercise device weight and the band of the weight taught by the Dorn patent do not adequately protect the exercise or competition surface from damage in the event that the barbell or dumbbell is dropped. Accordingly, what is needed is an impact absorbing weight for a barbell assembly that adequately protects any exercise or competition surface in any location in the event the barbell assembly or the weight is dropped, while reducing noise and providing increased safety to the user.

Existing barbell assemblies are useful for performing weight lifting exercises. However, a barbell assembly having conventional weights made of a metal or plastic material, whether or not coated or covered with a circumferential band of rubber, foamed plastic or other somewhat elastic material, is not suited for performing weight pushing and/or weight pulling exercises. In particular, as the amount of weight on the barbell is increased, conventional weights tend to gouge, scratch, dig into, or otherwise damage the surface on which the barbell assembly is pushed or pulled. As a result, athletes and body builders must locate and utilize heavily weighted exercise equipment, such as football sleds, to effectively perform weight pushing and weight pulling exercises. Accordingly, what is needed is a barbell assembly having weights suitable for performing weight pushing and weight pulling exercises that will not damage the surface on which the exercise is performed.

SUMMARY OF THE INVENTION

The invention is a barbell assembly having impact absorbing weights that can be used on any exercise or competition surface in any location without damaging the surface in the event the barbell assembly is dropped, while reducing noise and providing increased safety to the user. In an exemplary embodiment, a barbell assembly according to the invention includes an elongate bar having opposed ends and a weight subassembly mounted on the bar adjacent each of the opposed ends. Each weight subassembly includes a weight and an inflatable component adapted to be affixed to the weight and inflated. In a particularly advantageous embodiment, the weight is a vehicle wheel and the inflatable component is a vehicle tire that is affixed to the vehicle wheel and inflated.

In other exemplary embodiments, the weight of the weight subassembly has at least one through hole and the barbell assembly further includes a hub having a flange that defines at least one through hole corresponding to the through hole of the weight for attaching the weight and the inflatable component to the hub with at least one fastener. Preferably, the weight has a plurality of through holes that define a predetermined pattern and the flange has a plurality of through holes corresponding to the predetermined pattern. The hub is an elongate annular cylinder and has at least one through hole for receiving a fastener to secure the hub to the bar. Preferably, the hub has a plurality of internally-threaded through holes for receiving a corresponding plurality of externally-threaded fasteners to secure the hub to the bar. In another particularly advantageous embodiment, the barbell assembly further includes a cylindrical inner sleeve made of a deformable material and configured to be disposed between an inner surface of the hub and an outer surface of the bar. The inner sleeve deforms from a circular cross-section to a non-circular cross-section when the at least one fastener secures the hub to the bar by deforming the inner sleeve against the outer surface of the bar.

In other exemplary embodiments, a barbell assembly according to the invention includes an elongate, essentially rigid bar having opposed ends and a weight subassembly mounted on the bar adjacent each of the opposed ends. Each weight subassembly includes a weight having at least one through hole. The barbell assembly further includes a hub defining a flange having at least one through hole corresponding to the through hole of the weight, and the weight is attached to the flange of the hub by at least one fastener. In a particularly advantageous embodiment, the weight has a plurality of through holes that define a predetermined pattern and the flange has a plurality of through holes that define a plurality of predetermined patterns corresponding to predetermined patterns of through holes of a plurality of different weights.

In other exemplary embodiments, a barbell assembly according to the invention includes an elongate, generally cylindrical, essentially rigid bar having opposed ends and a weight subassembly mounted on the bar adjacent each of the opposed ends. Each weight subassembly includes a wheel having at least one through hole and an inflatable component. The barbell assembly further includes an elongate, annular hub defining a flange having at least one through hole corresponding to the at least one through hole of the wheel for securing the weight subassembly to the hub with a fastener. The barbell assembly further includes a cylindrical inner sleeve made of a deformable material and configured to be disposed between an inner surface of the hub and an outer surface of the bar. The hub has at least one through hole for receiving a fastener to secure the hub and the weight subassembly to the bar by deforming and compressing the inner sleeve against the outer surface of the bar. In a particularly advantageous embodiment, the wheel has a plurality of through holes that define a predetermined pattern and the flange has a plurality of through holes that define a plurality of predetermined patterns corresponding to predetermined patterns of through holes of a plurality of different wheels.

In other exemplary embodiments, a barbell assembly according to the invention further includes a rotatable swivel assembly attached to at least one end of the bar that includes a hook adapted to rotate relative to the bar. The hook defines an opening for receiving a tether to secure at least a portion of the barbell assembly to an immovable fixture. The barbell assembly, with or without the swivel assembly, allows an individual to perform a weight pushing exercise using the barbell assembly without causing damage to an exercise surface. The barbell assembly with the swivel assembly allows an individual to perform a weight pulling exercise using the barbell assembly and a tether attached between the individual and the hook of the rotatable swivel assembly at each end of the bar without causing damage to an exercise surface.

BRIEF DESCRIPTION OF THE DRAWING FIGURES

The invention, as well as the features, objects and advantages thereof set forth herein, will be better understood and appreciated when considered in light of the detailed description of exemplary embodiments thereof provided hereinafter and the accompanying drawing figures, wherein like reference characters indicate the same or similar parts, elements, components, assemblies or subassemblies.

DETAILED DESCRIPTION OF EXEMPLARY EMBODIMENTS OF THE INVENTION

Figure 1:
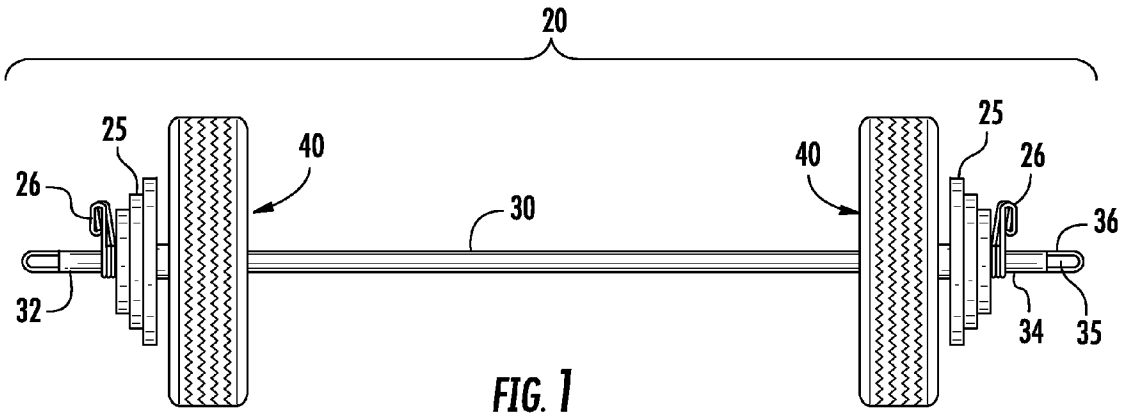
FIG. 1 is a plan view of an exemplary embodiment of a barbell assembly according to the invention.

The invention will be described more fully hereinafter with reference to the accompanying drawings in which one or more exemplary embodiments are shown. However, it is to be understood that the invention may be embodied in many different forms and should not be construed as limited to the exemplary embodiments set forth herein. Exemplary embodiments of the invention are provided herein so that this disclosure will fully and completely convey the broad scope of the invention and to enable one of ordinary skill in the art to make, use and practice the invention without undue experimentation. As previously mentioned, like reference characters in the detailed description and the accompanying drawing figures refer to the same or similar parts, elements, components or assemblies of the invention.

Figure 2:
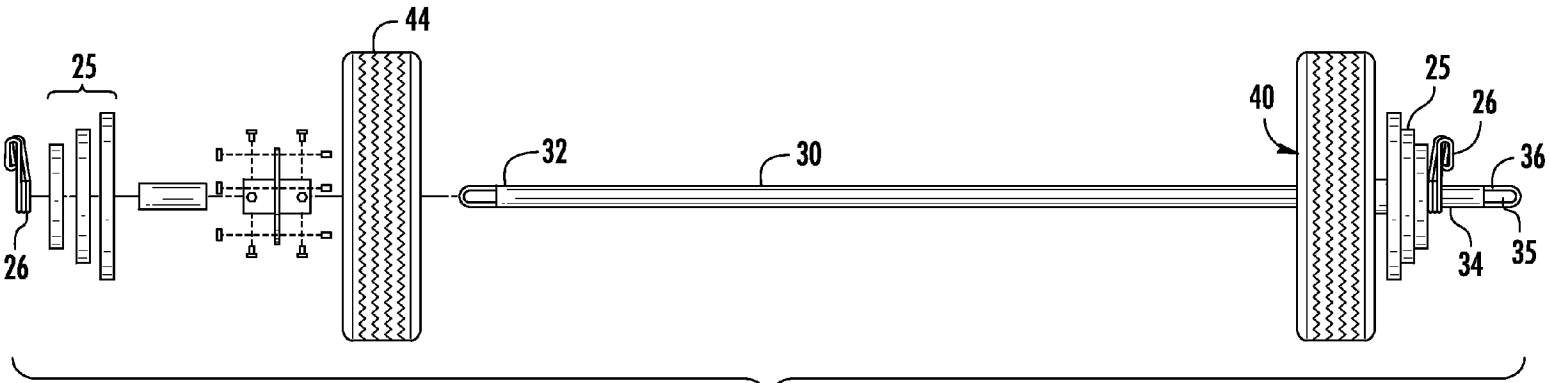
FIG. 2 is a partially exploded plan view of the barbell assembly of FIG. 1 shown with one end disassembled.

An exemplary embodiment of a barbell assembly constructed according to the invention is shown in FIG. 1 and FIG. 2. As shown, the barbell assembly, indicated generally by reference character 20, comprises an elongate bar 30 having opposed ends 32, 34, and a plurality of weight subassemblies 40 mounted on the bar adjacent the opposed ends. If desired, the barbell assembly 20 may further comprise one or more optional free weights 25 adjacent each of the opposed ends 32, 34 of the bar 30 to the outside of the weight subassemblies 40 and an optional collar 26 for retaining the free weights on the bar. The collar 26 may be a spiral spring clamp as shown herein, or alternatively, any suitable device for retaining the free weights 25 on the bar 30. In another embodiment not shown, the free weights 25 may be positioned on the bar 30 to the inside of the weight subassemblies 40 and retained by a mechanical stop provided on the bar or any other suitable retaining device. However, it may be preferred to position the free weights 25 to the outside of the weight subassemblies 40 and to utilize the hand-operated spiral spring clamps 26 as shown herein so that the additional weight provided by the optional free weights can be interchanged rapidly since a barbell assembly 20 according to the invention is used in essentially the same manner as a conventional barbell and weights for performing strength and conditioning exercises and for competing in weight-lifting, power-lifting and/or strong man competitions.

As shown herein, the elongate bar 30 of the barbell assembly 20 has opposed ends 32, 34 and is generally cylindrical in cross-sectional shape. However, the bar 30 may have any desired cross-sectional shape, particularly towards the center of the bar, that is suitable for being grasped by the hands of a user. For example, the cross-sectional shape of the bar 30 may be square, rectangular, or multi-sided (e.g. hexagonal, octagonal, etc.). Preferably, the bar 30 is symmetrical in cross-section for a purpose to be described hereinafter. Regardless, bar 30 is made of a high-strength, essentially rigid material, such as metal, capable of withstanding the bending loads imparted by the weight subassemblies 40 and/or the optional free weights 25 when the barbell assembly 20 is lifted from the exercise or competition surface without yielding. In an advantageous embodiment, the bar 30 is made of carbon steel and, if desired, may be chrome plated for enhanced smoothness and aesthetic purposes. In addition, the medial portion of the bar 30 between the weight subassemblies 40 may be provided with an etched or otherwise uneven surface, for example knurled, to provide an enhanced gripping surface for the user. Regardless, the material, hardening, plating, coating, surface treatment, etc. of the bar 30 is not essential to the invention as long as the bar has mechanical properties suitable for the use and purpose of the barbell assembly. As shown, bar 30 is provided with an optional hook 36 that defines an opening 35 on at least one of the opposed ends 32, 34 of the bar for a purpose to be described hereinafter.

Figure 3:
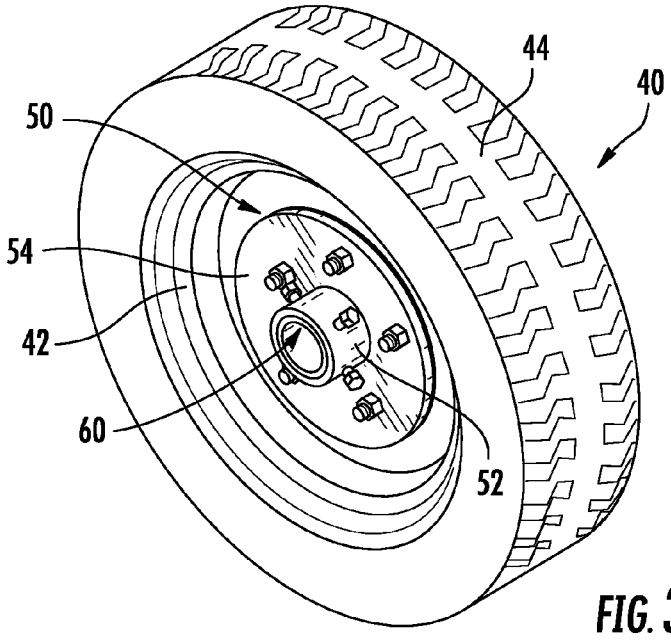
FIG. 3 is a perspective view of an exemplary embodiment of a typical weight subassembly for use with the barbell assembly of FIG. 1.
Figure 4:
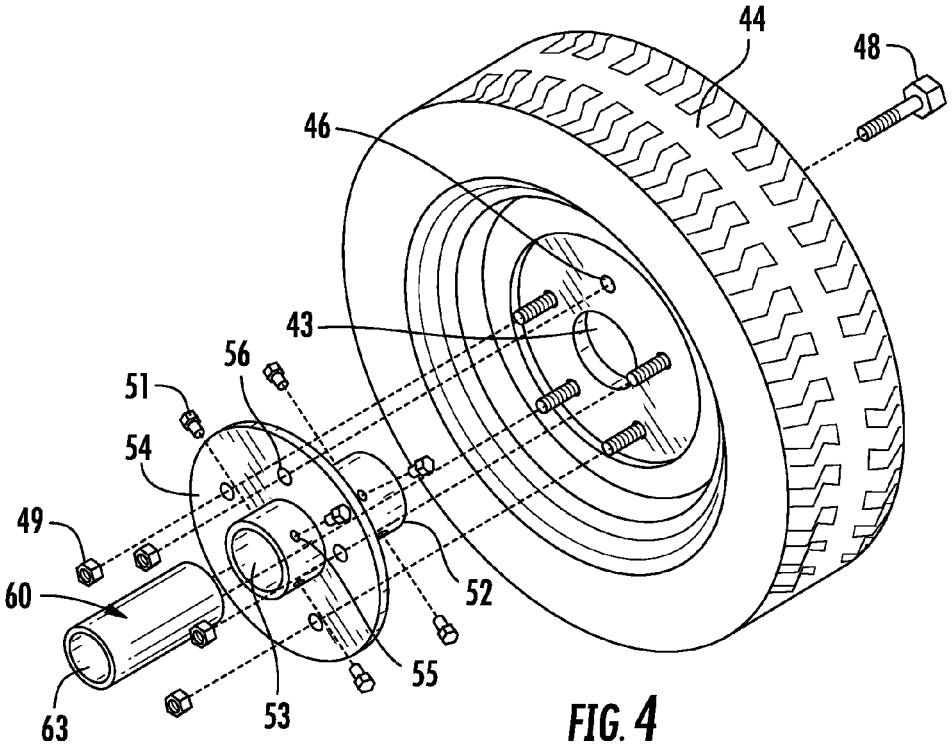
FIG. 4 is an exploded perspective view of the weight subassembly of FIG. 3.

A typical weight subassembly 40 for use with a barbell assembly 20 according to the invention is shown in FIG. 3 and FIG. 4. Each of the weight subassemblies 40 comprises a weight 42 and an inflatable component 44 adapted for being attached to the weight and inflated. It is a particularly advantageous feature of the invention that the inflatable component 44 has a generally hollow interior 45 (FIG. 5) that is filled with a gas, for example air, so that the barbell assembly 20 can be used on any exercise or competition surface in any location without damaging the surface in the event that the barbell assembly or one of the weight subassemblies 40 is dropped. In addition, the inflated inflatable component 44 reduces noise during use of the barbell assembly 20 and provides increased safety to the user. These attributes are achieved because the weight subassembly 40, and in particular, the inflatable component 44 absorbs a significant amount of the kinetic and potential energy associated with dropping the barbell assembly 20 and/or a weight subassembly 40. By way of example and not limitation, a barbell assembly 20 constructed according to the invention can be used on a softer outdoor surface without causing indentations or other damage to a lawn or yard. Alternatively, the barbell assembly 20 can be used on a harder indoor or outdoor surface without causing cracking or other damage to a concrete floor or to a concrete or paved sidewalk, driveway or the like. As will be readily apparent, understood and appreciated by those skilled in the art, the inflatable component 44 may also be inflated, or more specifically, filled with a compressible liquid instead of a gas with only a minimal reduction in the energy absorbing capability of the weight subassembly.

As shown and described herein, each weight subassembly 40 comprises a generally cylindrical, annular weight 42 in the form of a wheel having an outer periphery, and an inflatable component 44 mounted on the outer periphery of the wheel. A hub 50 is provided for being attached to the wheel 42 and for subsequently attaching the weight subassembly 40 to the bar 30 of the barbell assembly 20. An optional inner sleeve 60 configured for being disposed between the hub 50 and the bar 30 may also be provided for a purpose to be described hereinafter. The wheel 42 defines a central axial opening 43 configured, and in particular sized and shaped, for receiving an end 32, 34 of the bar 30. The wheel 42 further defines a plurality of through holes 46 (FIG. 4) formed and arranged in a predetermined pattern on a common diameter distance from the center of the wheel. In a particularly advantageous embodiment, wheel 42 is a conventional vehicle wheel having a predetermined pattern of lug holes 46 configured for mating with a vehicle hub having a corresponding predetermined lug pattern. Furthermore, the inflatable component 44 is a conventional inflatable vehicle tire sized to fit the vehicle wheel. Preferably, the wheel 42 is a conventional trailer wheel made of metal and the inflatable component 44 is a conventional trailer tire made of rubber that is mounted on the trailer wheel and inflated. By way of example and not limitation, wheel 42 may be a trailer wheel having a predetermined pattern of five (5) lug holes 46 on a four and one-half (4½) diameter distance, commonly referred to as a "545" trailer wheel. The inflatable component 44 is a corresponding trailer tire properly sized for the trailer wheel and having any suitable tire tread. In an advantageous embodiment, used and/or discarded trailer wheels and tires may be used to reduce the overall cost of the barbell assembly 20.

The hub 50 comprises an elongate, generally cylindrical, annular sleeve 52 and a cylindrical, annular flange 54 that is disposed about and depends radially outward from the sleeve. The sleeve 52 and the flange 54 may be integrally formed from a suitable high-strength, substantially rigid material, such as metal, plastic or composite. Alternatively, the sleeve 52 and the flange 54 may be formed separately and the flange affixed to the sleeve in any suitable manner, for example by press fit, welding, brazing, soldering, fusing, etc. For purposes of material cost and ease of manufacture, the sleeve 52 and the flange 54 are preferably separately formed of machined metal and the surface at the inner periphery of the flange is welded to the surface at the outer periphery of the sleeve. The weld between the flange 54 and the sleeve 52 may be continuous, or alternatively, may be a series of spot welds spaced circumferentially around the outer periphery of the sleeve. Regardless, sleeve 52 defines a central axial opening 53 configured, and in particular sized and shaped, for receiving an end 32, 34 of the bar 30. Sleeve 52 further has a plurality of through holes 55 configured for receiving at least one, and preferably, a corresponding plurality of fasteners 51 to secure the hub 50 to the bar 30, as will be described. Flange 54 defines a plurality of through holes 56 formed and arranged in the same predetermined pattern as the through holes 46 of the wheel 42. Accordingly, the hub 50 can be attached to the wheel 42 of the weight subassembly 40 by at least one, and preferably, a corresponding plurality of fasteners, such as the externally-threaded bolts 48 and internally-threaded mating nuts 49.

Figure 5:
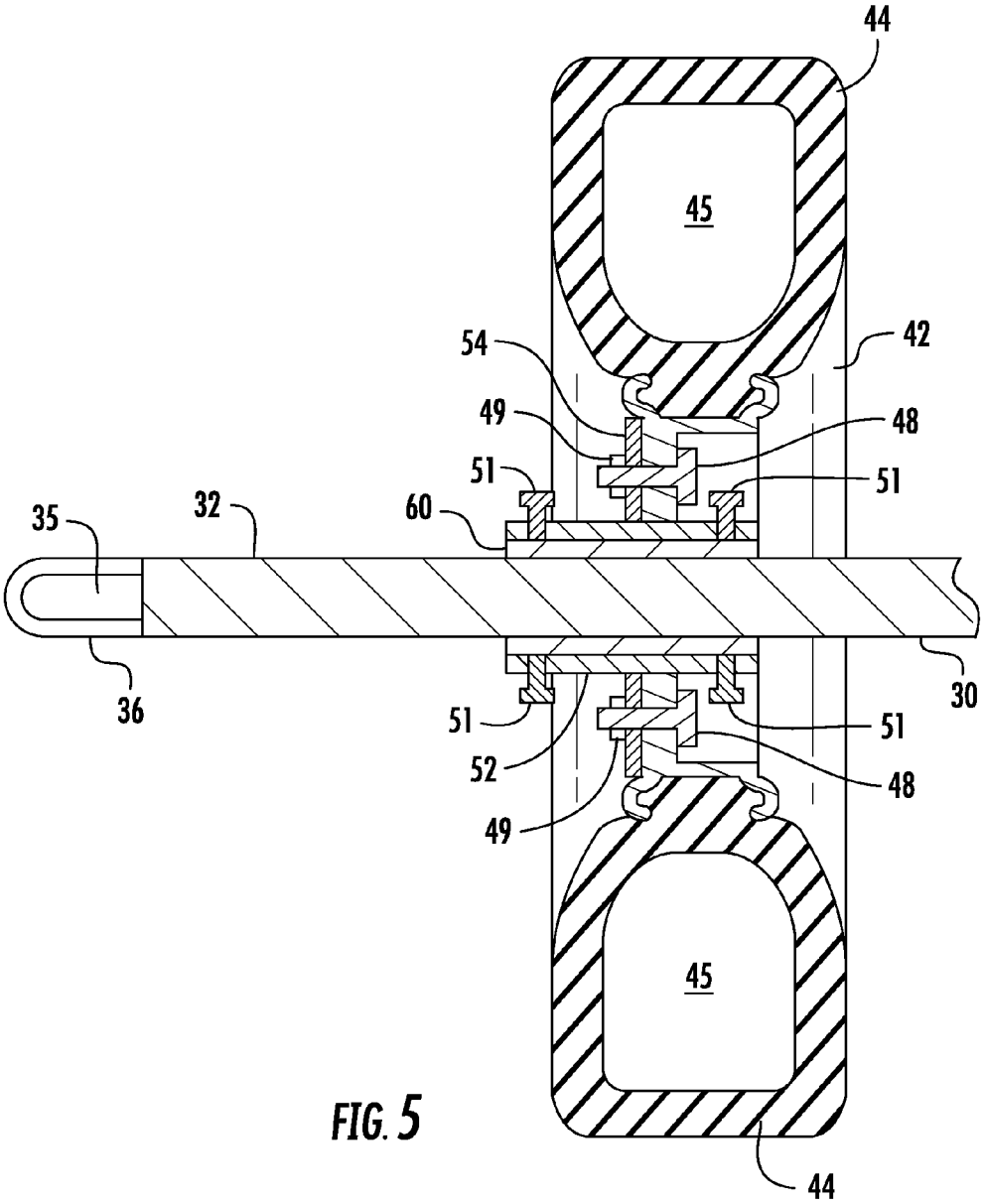
FIG. 5 is a sectional view of one end of the barbell assembly of FIG. 1.

FIG. 5 best illustrates the manner in which the wheel 42 of the weight subassembly 40, is secured to the hub 50, and the weight subassembly 40 including the hub is subsequently secured to the bar 30 of the barbell assembly 20. The sleeve 52 of the hub 50 is inserted into the central opening 43 of the wheel 42 until the flange 54 of the hub seats against the lateral surface of the wheel. As previously mentioned, the flange 54 of the hub 50 has at least one, and preferably, a plurality of through holes 56 that correspond to the predetermined pattern of through holes 46 formed on the wheel 42 of the weight subassembly 40. The through holes 56 of the flange 54 are aligned with the through holes 46 of the wheel 42. Then, at least one, and preferably, a corresponding plurality of threaded fasteners 48, for example lag bolts, are inserted within the through holes 46, 56 and engaged with corresponding threaded nuts 49 to secure the wheel 42 to the flange 54 of the hub 50. The central opening 53 of the hub 50 is then positioned around an end 32 of the bar 30 and the weight subassembly 40, including the hub 50, is slid along the length of the bar to a desired position adjacent the end of the bar. As previously mentioned, the sleeve 52 of the hub 50 has a plurality of internally-threaded through holes 55 for receiving a corresponding plurality of externally-threaded fasteners 51, for example lag bolts. The fasteners 51 are threaded into the through holes 55 until the head of the lag bolt engages the outer surface of the bar 30 to secure the weight subassembly 40 to the bar.

Figure 6:
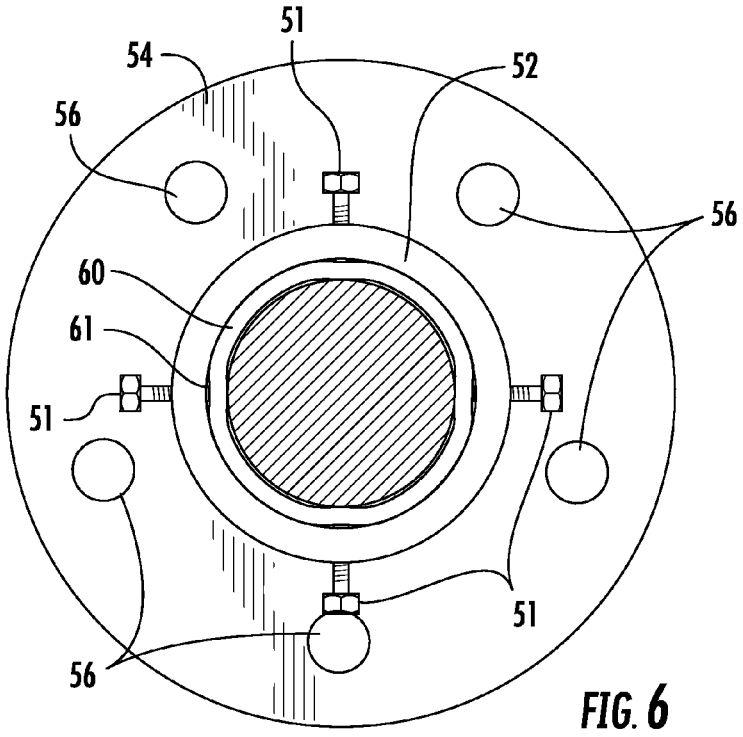
FIG. 6 is an end view of an exemplary embodiment of a typical hub for use with the barbell assembly of FIG. 1.

Alternatively, as shown and described herein, the optional inner sleeve 60 is first inserted into the central opening 53 of the hub 50. Preferably, the inner surface of the sleeve 52 of the hub 50 and the outer surface of the inner sleeve 60 define a slight interference fit so that the inner sleeve is retained within the sleeve of the hub. The wheel 42 is then secured to the flange 54 of the hub 50 in the manner previously described. Next, the central opening 63 of the inner sleeve 60 is positioned around an end 32 of the bar 30 and the weight subassembly 40, including the hub 50 and the inner sleeve 60, is slid along the length of the bar to a desired position adjacent the end of the bar. The fasteners 51 are then threaded into the through holes 55 formed in the sleeve 52 of the hub 50 until the head of the lag bolt engages the outer surface of the inner sleeve 60. The inner sleeve is an elongate, annular cylinder made of a somewhat deformable and elastic material, such as polyethylene, polypropylene or polyvinyl chloride (PVC) pipe. Accordingly, as best shown in FIG. 6, the inner sleeve 60 deforms from a circular cross-section to a non-circular cross-section when the fastener 51 secures the hub 50 and the weight subassembly 40 to the bar 30 by deforming the inner sleeve against the outer surface of the bar in the area 61 adjacent the head of the fastener. The deformation of the inner sleeve 60 increases the surface area in contact with the outer surface of the bar 30, and thereby provides additional friction that acts to prevent the weight subassembly 40 from rotating (i.e. slipping) relative to the bar of the barbell assembly 20.

As shown herein, the sleeve 52 of the hub 50 preferably has a total of eight (8) through holes 55 for receiving a corresponding eight (8) fasteners 51 with four (4) of the through holes being formed on each lateral side of the flange 54. In a particularly advantageous embodiment, the four (4) through holes 55 on each lateral side of the flange 54 are spaced circumferentially ninety degrees (90°) apart around the outer periphery of the sleeve 52 such that the holes are arranged in diametrically-opposed pairs. It is believed that the preferred arrangement of four (4) pairs of diametrically opposed through holes 55 and fasteners 51 provides a desirable degree of rigidity in the connection between the weight subassembly 40 and the bar 30 of the barbell assembly 20. In the event that the optional inner sleeve 60 is not used, the heads of the fasteners 51 engage the outer surface of the bar 30 at two (2) sets of diametrically-opposed locations on each lateral side of the flange 54. It is believed that under normal use conditions the eight fasteners 51 that attach each weight subassembly 40 to the bar 30 are sufficient for securing the weight subassembly, including the hub 50, against movement along the length of the bar, as well as rotation relative to the bar. Although hexagonal lag bolts 48, 51 and hexagonal nuts 49 have been shown in accompanying drawing figures, one of ordinary skill in the art will readily appreciate that thumb screws or the like may be substituted for the hexagonal lag bolts and hexagonal nuts may be replaced by wing nuts or the like.

Figure 7:
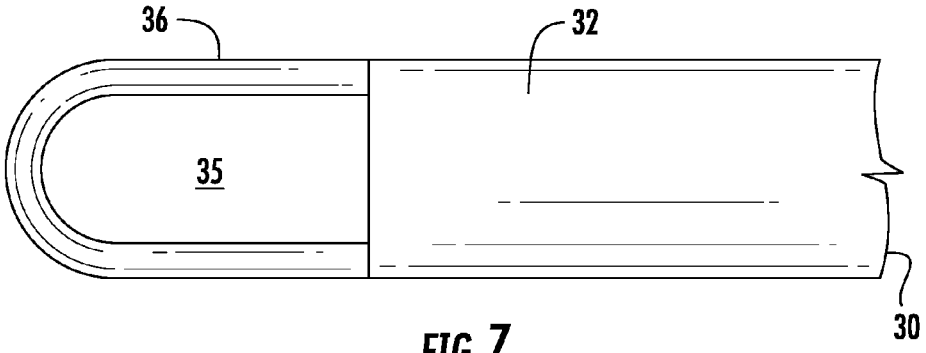
FIG. 7 is a plan view showing an optional hook at one end of the bar of the barbell assembly of FIG. 1.
Figure 8:
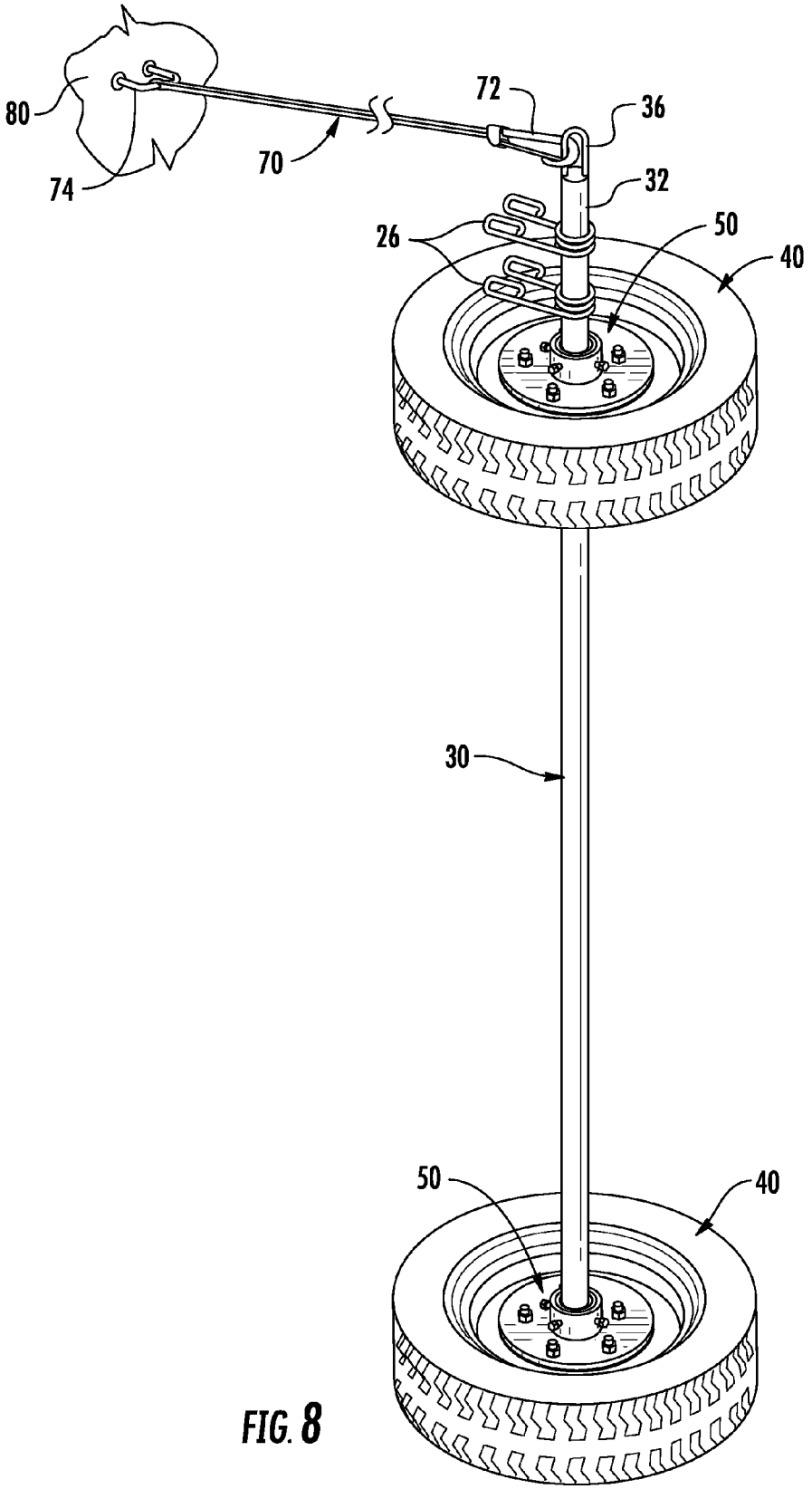
FIG. 8 is a perspective view illustrating an exemplary embodiment of a method for conveniently storing a barbell assembly according to the invention.

FIG. 7 shows an enlarged plan view of one end 32 of the bar 30 of the barbell assembly 20 shown and described herein. As previously mentioned, the end 32 of the bar 30 may be provided with a hook 36 that defines an opening 35. FIG. 8 illustrates an exemplary embodiment of a method according to the invention for conveniently storing the barbell assembly 20 in a generally vertical orientation. The opening 35 is configured, and in particular sufficiently sized and appropriately shaped for receiving a carabineer, or clip 72 provided at an end of a relatively inelastic rope, strap or band 70. The other end of the rope, strap or band 70 may, by way of example and not limitation, be provided with a cleat 74 adapted to be secured to an immovable surface 80, such as an overhead ceiling or a sidewall of a building structure, in a suitable manner. As a result, the barbell assembly 20 having at least one weight subassembly 40 may be supported in a generally vertical orientation for space-saving storage within the building structure, for example a gym, garage, storage shed or the like. As best shown in FIG. 8, the weight subassembly 40 at the opposite end of the bar 30 is re-positioned at the end 34 of the bar and fasteners 51 are engaged with the outer surface of optional inner sleeve 60 or bar 30, in the manner previously described, such that the inflatable component (i.e. trailer tire) 44 rests on the floor of the building structure. Additional weight subassemblies 40 (including the weight subassembly shown adjacent the end 32 of the bar 30 in FIG. 8) and/or free weights 25 (not shown) may be stacked (secured or unsecured) on top of the weight subassembly resting on the floor of the building structure. Alternatively, additional weight subassemblies 40 and/or free weights 25 may be secured on the bar 30 medially between the opposed ends 32, 34.

Figure 9:
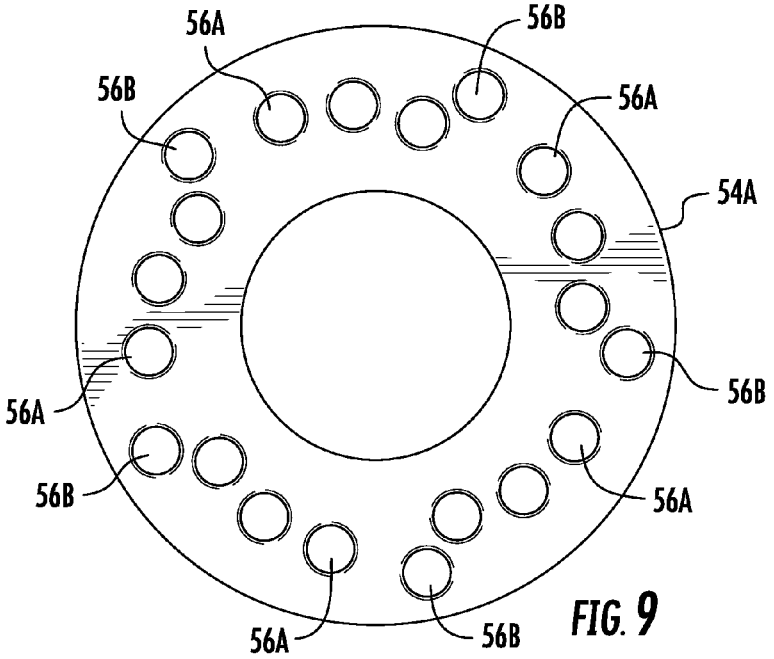
FIG. 9 is a plan view of an alternative embodiment of a flange for use with the hub of a barbell assembly according to the invention.
Figure 10:
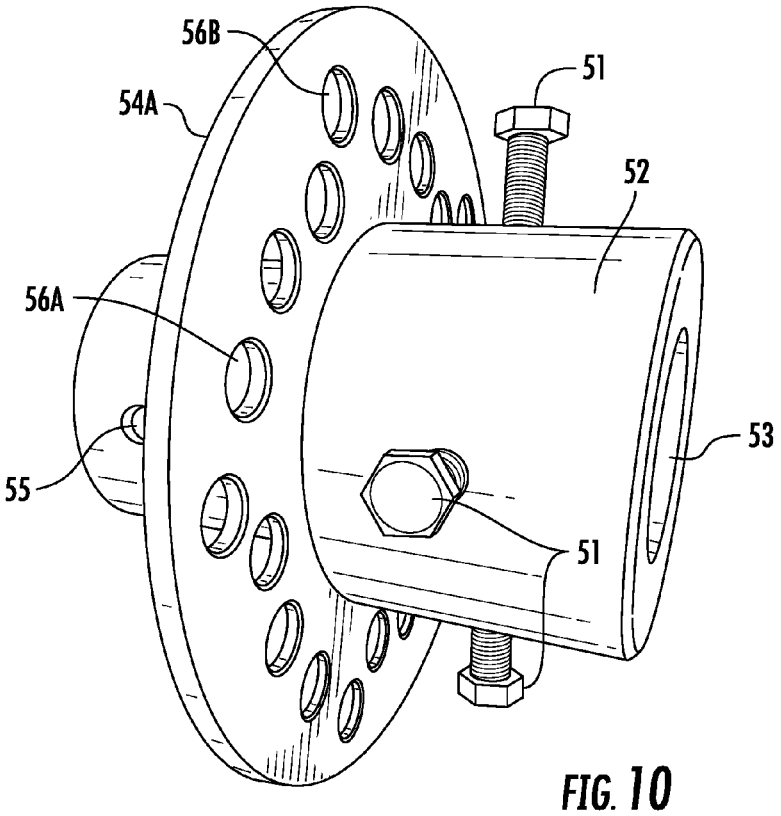
FIG. 10 is a perspective view showing the flange of FIG. 9 mounted on the hub of the barbell assembly shown in FIG. 6.

FIG. 9 shows an alternative embodiment of a flange 54A suitable for use with a barbell assembly 20 constructed in accordance with the invention. Flange 54A is formed with a plurality of through holes that define a plurality of predetermined patterns of through holes. By way of example and not limitation, the plurality of through holes define a predetermined pattern of through holes indicated by reference character 56A and another predetermined pattern of through holes indicated by reference character 56B. Each of the predetermined patterns of through holes 56A, 56B consist of five (5) through holes that correspond to a predetermined pattern of through holes provided on a standard type of vehicle wheel. As such, the flange 54A can be utilized to secure a great number of the vehicle wheels that are currently in use in the United States today to the barbell assembly 20. As shown in FIG. 10, the flange 54A may be affixed to the sleeve 52 of the hub 50 in the manner previously described, for example by spot or tack welding the inner periphery of the flange to the outer periphery of the sleeve. Accordingly, the flange 54A may be utilized with or without the optional inner sleeve 60 to secure the wheel 42 of the weight subassembly 40 to the hub 50, and the sleeve 54 may be utilized to secure the weight subassembly, including the hub, to the bar 30 of the barbell assembly 20 in the manner previously described.

Figure 11:
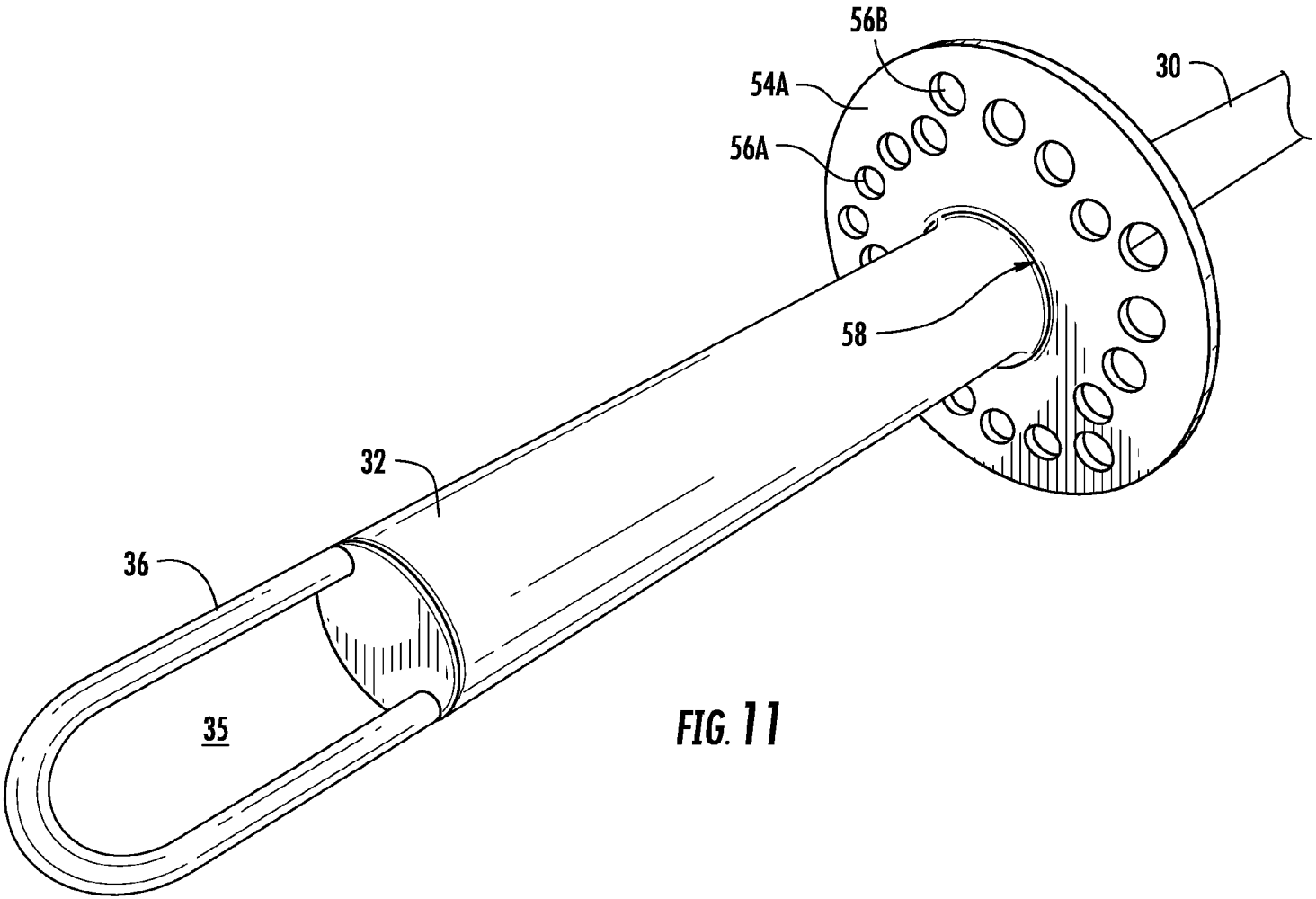
FIG. 11 is a perspective view illustrating the flange shown in FIG. 9 attached to a bar for use with another exemplary embodiment of a barbell assembly according to the invention.

FIG. 11 shows the flange 54A of FIG. 9 as used with another exemplary embodiment of a barbell assembly 20 constructed in accordance with the invention. In this embodiment, the flange 54A is affixed directly to the bar 30 adjacent one end 32 of the bar. By way of example and not limitation, the inner periphery of the flange 54A may be welded to the outer periphery of the bar 30 along a weld line indicated by reference character 58 in FIG. 11. By affixing the flange 54A directly to the bar 30, the sleeve 52 of the hub 50 and the inner sleeve 60 are eliminated, and consequently, the rigidity of the connection between the weight subassembly 40 and the bar 30 is increased. As previously described, the flange 54A has a plurality of through holes that define a plurality of predetermined patterns of through holes, such as the series of through holes indicated by reference characters 56A and 56B. Each predetermined pattern of through holes formed in the flange 54A is configured to correspond to a predetermined pattern of through holes provided on a wheel 42 of a weight subassembly 40 and to receive at least one, and preferably, a corresponding plurality of fasteners 48 to secure the weight subassembly to the flange in the manner previously described.

Figure 12:
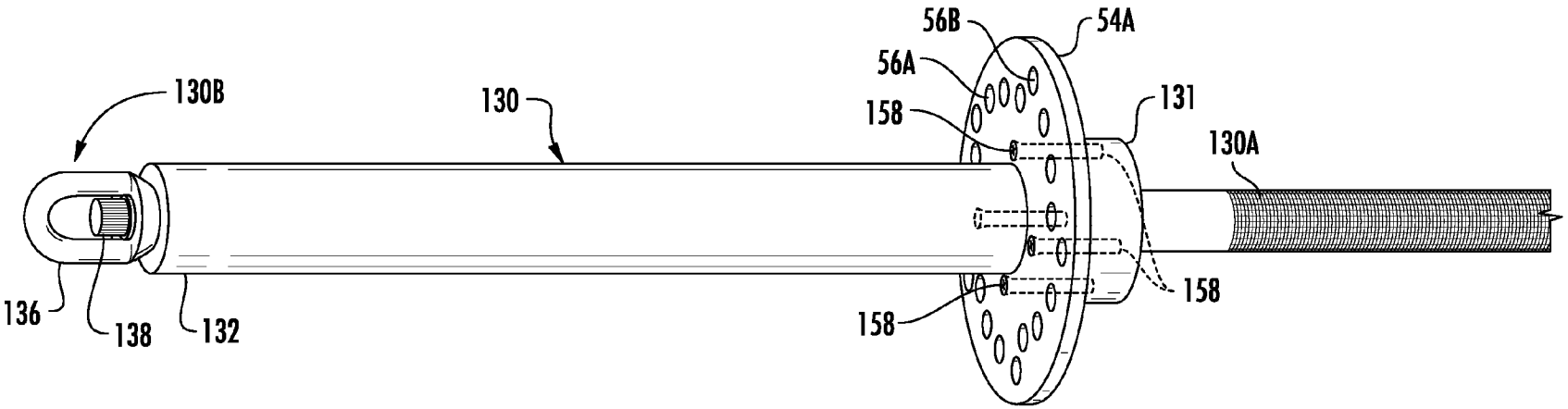
FIG. 12 is a perspective view illustrating the flange shown in FIG. 9 attached to a standard Olympic bar and a swivel at an end of the bar for use with another exemplary embodiment of a barbell assembly according to the invention.

FIG. 12 shows the flange 54A of FIG. 9 as used with another exemplary embodiment of a barbell assembly 20 constructed in accordance with the invention. In this embodiment, the flange 54A is affixed directly to a standard Olympic bar 130 adjacent the outer end 132 of the bar. The term "Olympic bar" (also commonly referred to as a "weightlifting bar") refers to the standard bar used in men's and women's competitive weightlifting at the highest lever, including the Commonwealth Games, the Pan American Games, the World Championships and the Olympics. A men's Olympic bar is 7.4 ft (2.2 m) long and weighs 44.1 lbs. (20 kg). The outer ends of the men's Olympic bar are 1.97 in. (50 mm) in diameter, while the grip portion is 1.10 in. (28 mm) in diameter. The women's Olympic bar has the same overall configuration, but with smaller dimensions. A women's Olympic bar is only 6.75 ft. (2.05 m) in length, weighs only 33.1 lbs. (15 kg), and has a grip portion of just 0.98 in. (25 mm) diameter. Unlike a power lifting bar, the outer ends of the Olympic bar rotate to prevent the weight plates mounted on the bar from twisting the arms and wrists of the lifter.

As shown in FIG. 12, a plurality of holes are formed through the thickness of the flange 54A adjacent the inner periphery of the flange for receiving a corresponding plurality of fasteners 158 that affix the flange directly to the collar 131 of the outer end 132 adjacent the grip portion 130A of the bar 130. For example, the bushing 131 may be provided with a corresponding plurality of internally-threaded "tapped" holes for being engaged by externally-threaded screws or bolts commercially known as "Allen-head" fasteners. The holes formed through the flange 54A may be formed with a countersink and the heads of the fasteners chamfered so that the surface of the flange adjacent the outer end 132 of the bar 130 remains flush to receive the wheel 42 of the weight subassembly 40, as previously described. By affixing the flange 54A directly to the bar 130, the sleeve 52 of the hub 50 and the inner sleeve 60 are eliminated, and consequently, the rigidity of the connection between the weight subassembly 40 and the bar 130 is increased. As previously described, the flange 54A has a plurality of predetermined patterns of through holes, indicated by reference characters 56A and 56B, configured to correspond to a predetermined pattern of through holes provided on a wheel 42 of a weight subassembly 40. The through holes of the predetermine pattern receive a corresponding plurality of fasteners 48 to secure the weight subassembly to the flange in the manner previously described.

FIG. 12 also shows a swivel assembly 130B rotatably attached to the outer end 132 of the Olympic bar 130. As previously mentioned, the outer end 132 of the Olympic bar 130 rotates relative to the grip portion 130A. In particular, the cross-section of the outer end 132 is annular and the grip portion 130A extends into the outer end for substantially the entire length. The outer end 132 is closed with a cap (not shown) having a through hole and formed with a countersink, and the grip portion 130A is internally-threaded adjacent the cap to receive an externally-threaded fastener, such as an Allen-head bolt, that secures the outer end on the grip portion, while permitting rotation of the outer end 132 relative to the grip portion 130A of the bar 130. In the exemplary embodiment illustrated in FIG. 12, the swivel assembly 130B replaces the Allen-head bolt of the conventional Olympic bar, and is configured to further permit rotation of a U-shaped hook 136 relative to the outer end 132 and the grip portion 130A in addition to rotation of the outer end 132 relative to the grip portion 130A.

Figure 13:
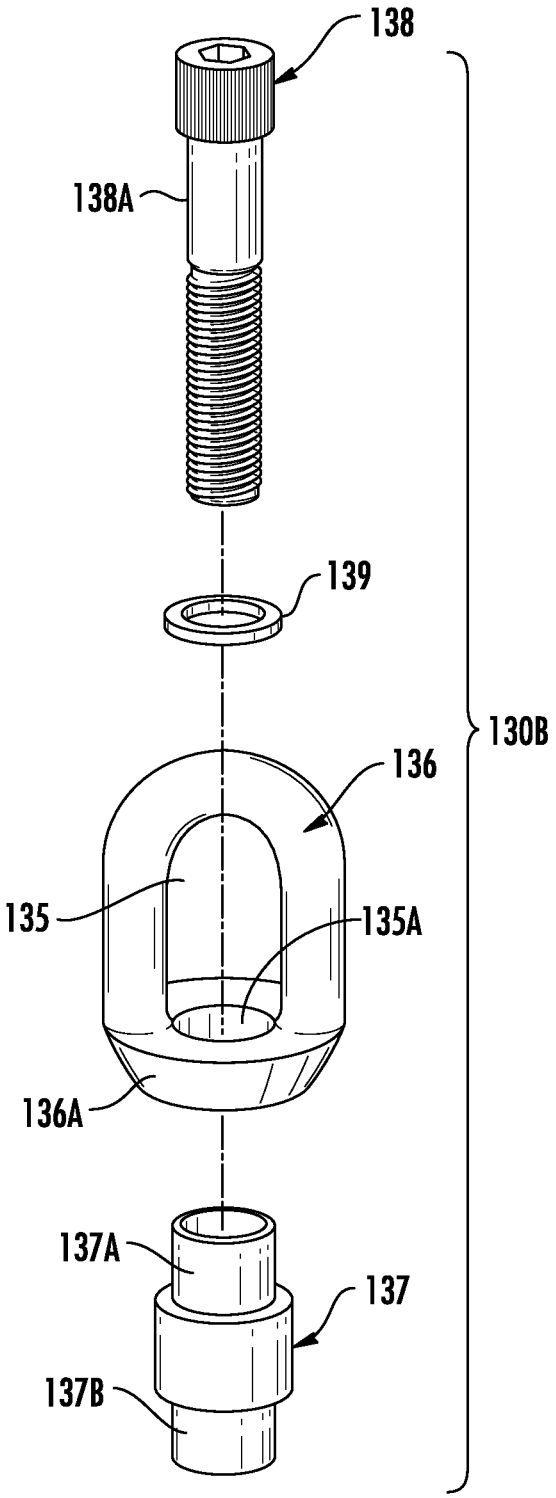
FIG. 13 is an exploded perspective view of the swivel of FIG. 12.

FIG. 13 is an exploded view showing the various components of the swivel assembly 130B in greater detail. As shown, the swivel assembly 130B comprises the U-shaped hook 136 defining an opening 135, a double-sided barrel bushing 137, a fastener 138, and a lock washer 139. The hook 136 is provided with a chamfer portion 136A and defines a through hole 135A opposite the opening 135. One end 137A of the double-sided barrel bushing 137 is sized to be received within the through hole 135A and to extend slightly into the opening 135. The other end 137B of the bushing 137 is sized to be received within the countersink formed in the cap of the outer end of a conventional Olympic bar. Fastener 136 is an Allen-head bolt similar to the Allen-head bolt of the conventional Olympic bar. However, fastener 136 is slightly longer than the conventional Allen-head bolt, and more specifically, is longer than the conventional Allen-head bolt by at least the thickness of the chamfer portion 136A of the hook 136. Lock washer 139 is sized to have an inner diameter greater than the outer diameter of the shank portion 138A of the fastener 138 and an outer diameter greater than the through hole 135A defined by the hook 136.

Figure 14:
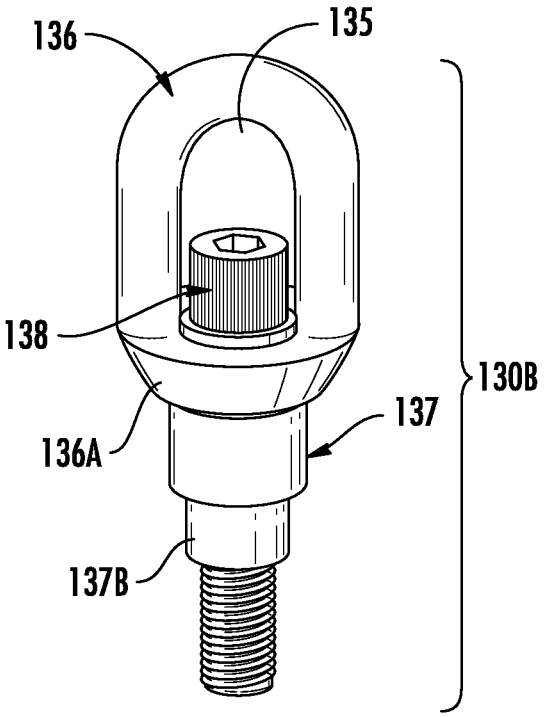
FIG. 14 is a perspective view showing the swivel of FIG. 13 in an assembled configuration.

FIG. 14 shows the swivel assembly 130B in an assembled configuration prior to being attached to the outer end 132 of the Olympic bar 130. The one end 137A of the double-sided barrel bushing 137 is inserted into the through hole 135A defined by the hook 136. The lock washer 139 is positioned over the shank portion 138A of the fastener 138. The fastener 138 with the lock washer 139 disposed thereon is then inserted via the opening 35 into the through hole 135A and through the bushing 137. It should be noted that a sufficient portion of the threads of the externally-threaded Allen-head bolt fastener 138 are available beyond the bushing 137 to engage the internally-threaded "tapped" hole provided in the grip portion 130A of the bar 130 adjacent the cap formed in the outer end 132 of the bar. The swivel assembly 130B, as shown in FIG. 14, is positioned over the cap provided on the outer end 132 of the bar 130 with the other end 137B of the bushing 137 disposed within the countersink formed in the cap. The head of the fastener 138 is then tightened by a suitable Allen-head tool to engage the threads of the fastener with the internally-threaded "tapped" hole provided in the grip portion 130A of the bar disposed within the outer end 132 of the bar. The lock washer 139 and the head of the fastener 138 engage with the one end 137A of the bushing 137 such that the hook 136 is substantially free to rotate relative to the grip portion 130A and the outer end 132 of the bar 130.

Figure 15:
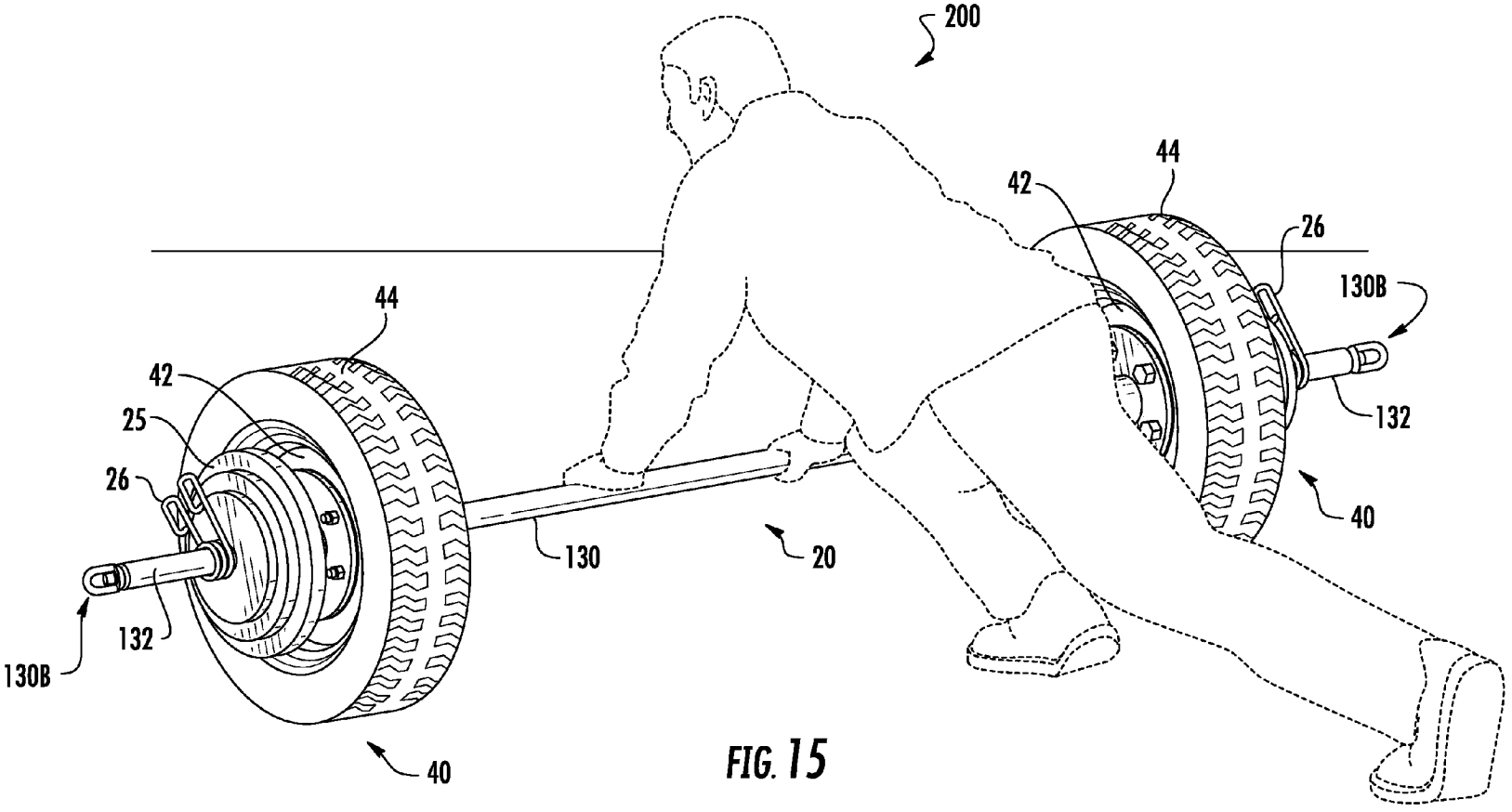
FIG. 15 is an environmental perspective view illustrating an exemplary embodiment of a method for performing a weight pushing exercise using a barbell assembly according to the present invention.

FIG. 15 illustrates an exemplary embodiment of a method 200 for performing a weight training exercise using a barbell assembly 20 constructed in accordance with the present invention. More specifically, FIG. 15 illustrates an exemplary embodiment of a method for performing a weight pushing exercise. As shown, an individual, for example a strongman competitor, weightlifter or other athlete, is positioned to grasp the Olympic bar 130 medially between the weight subassemblies 40 mounted on the bar. The individual then pushes the barbell assembly 20, including the bar 130 and the weight subassemblies 40, by generating a driving force with his or her legs. Because the weight subassemblies 40 of the barbell assembly 20 utilize a weight 42 and an inflatable component 44 adapted to be attached to the periphery of the weight, as previously described with reference to FIG. 5, the weight pushing exercise does not cause damage to the surface on which the exercise is performed. Instead, the inflatable component 44 (i.e., trailer tire) rolls harmlessly over the surface. Accordingly, as will be readily appreciated by those skilled in the art, the relatively inexpensive barbell assembly 20 can be used in place of expensive, heavily weighted exercise equipment, such as a football sled, to achieve substantially the same exercise benefits.

Figure 16:
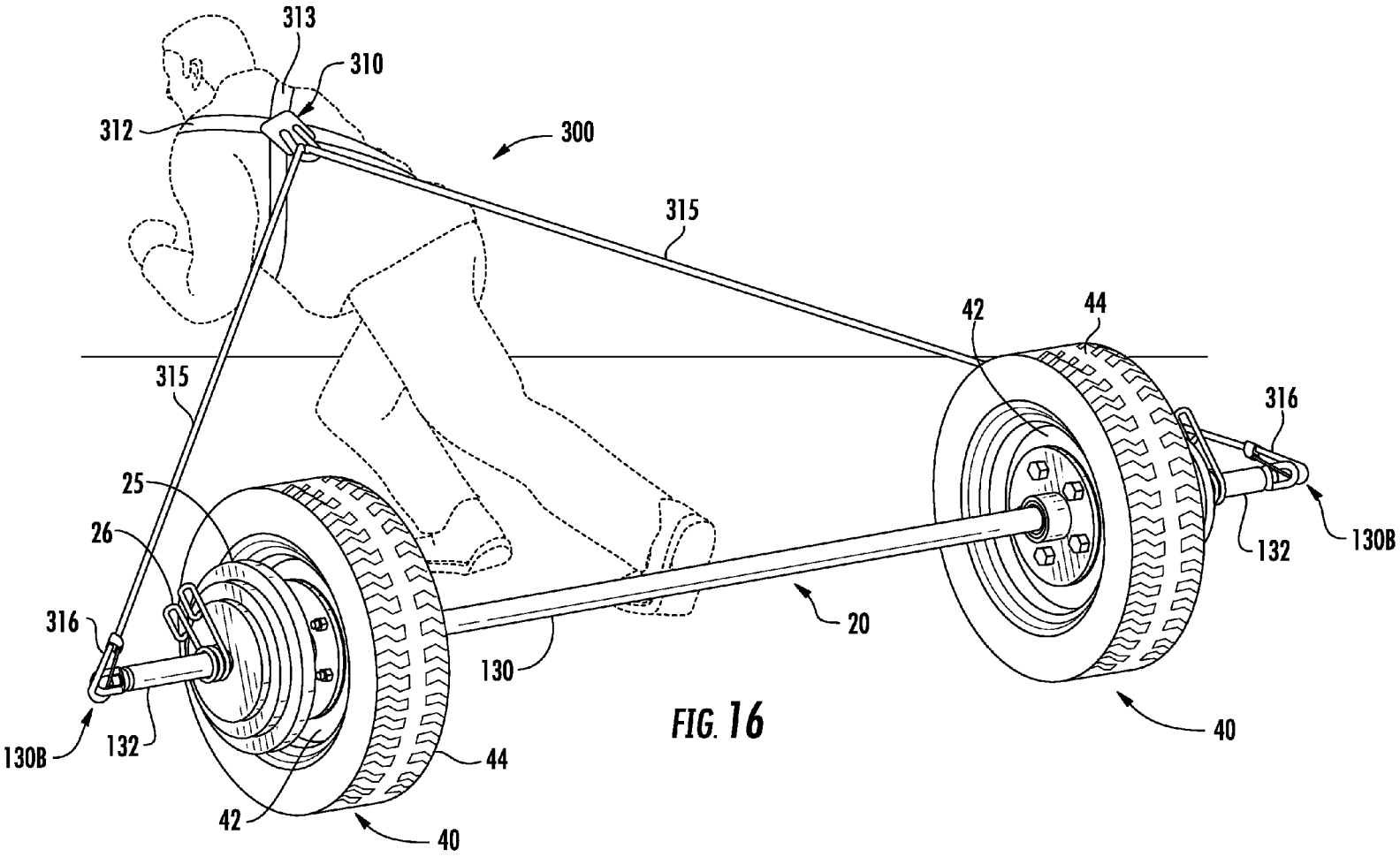
FIG. 16 is an environmental perspective view illustrating another exemplary embodiment of a method for performing a weight pulling exercise using a barbell assembly according to the present invention.

FIG. 16 illustrates another exemplary embodiment of a method 300 for performing a weight training exercise using a barbell assembly 20 constructed in accordance with the present invention. More specifically, FIG. 16 illustrates an exemplary embodiment of a method for performing a weight pulling exercise. As shown, an individual, for example a strongman competitor, weightlifter or other athlete, is fitted with a harness 310 that is attached to the barbell assembly 20. The harness 310 may be configured to be worn on the individual's upper torso and may comprise straps 312, 313 that secure the harness over the shoulders and around the chest of the individual. Regardless, a sufficient length of an elongate, relatively inelastic tether 315, for example a cable, rope, chain, or the like, extends between the harness and the outer ends 132 of the bar 130 of the barbell assembly 20. Each end of the tether 315 is provided with an attachment 316, for example a conventional carabineer clip, sized to engage the opening 135 defined by the hook 136 of the swivel assembly 130B (see e.g., FIG. 12). The individual then pulls the barbell assembly 20, including the bar 130 and the weight subassemblies 40, by generating a driving force with his or her legs. Because the weight subassemblies 40 of the barbell assembly 20 utilize a weight 42 and an inflatable component 44 adapted to be attached to the periphery of the weight, the weight pulling exercise does not cause damage to the surface on which the exercise is performed. Instead, the inflatable component 44 (i.e., trailer tire) rolls harmlessly over the surface. Accordingly, as will be readily appreciated by those skilled in the art, the relatively inexpensive barbell assembly 20 can be used in place of expensive, heavily weighted exercise equipment, such as a football sled, to achieve substantially the same exercise benefits. It should be noted that the swivel assembly 130B provided at each outer end 132 of the bar 130 allows the outer end and the weight subassembly 40 affixed thereto to rotate freely relative to the swivel assembly to facilitate the pulling exercise.

Figure 17:
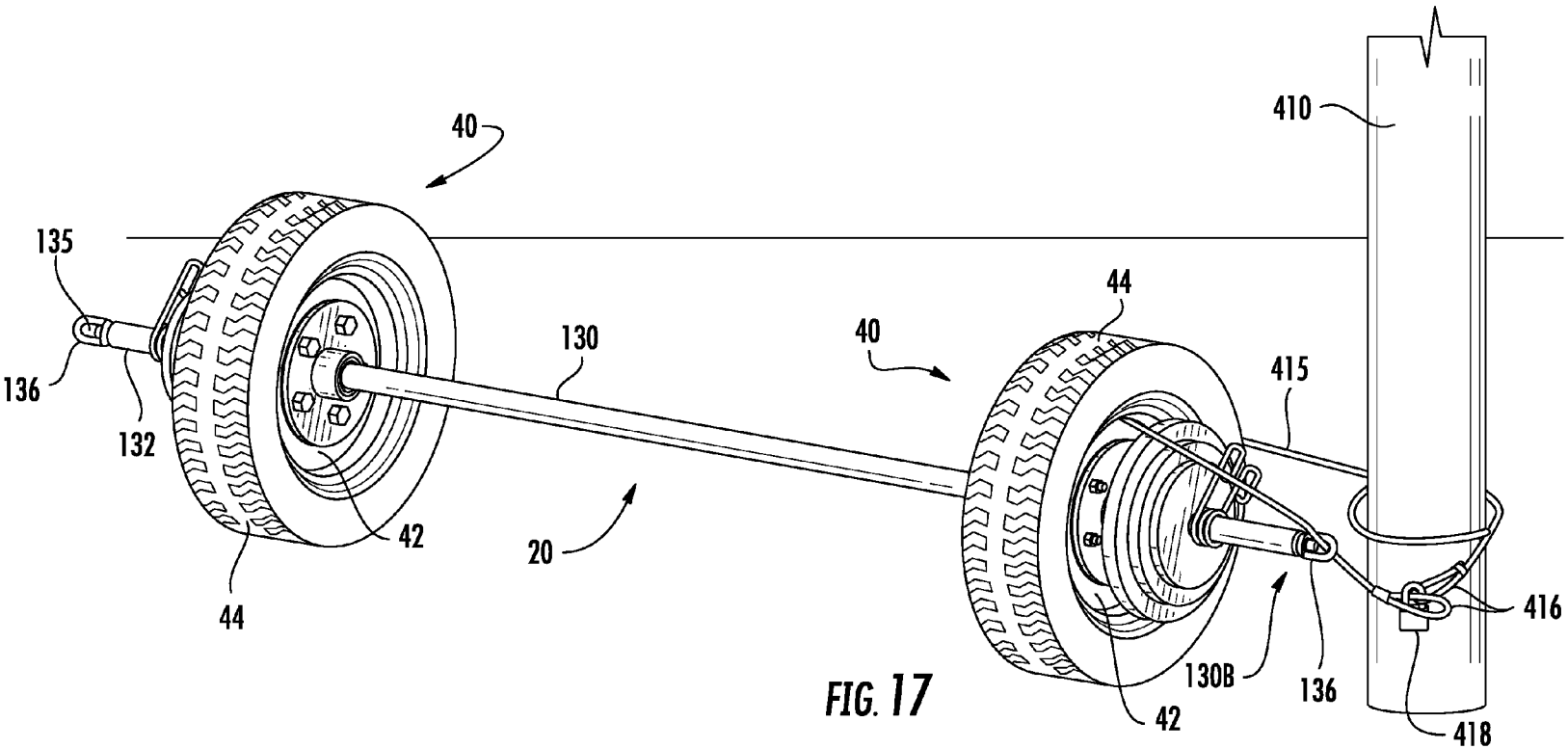
FIG. 17 is an environmental perspective view illustrating an exemplary embodiment of a method for securing a barbell assembly according to the present invention to an immovable fixture.

FIG. 17 illustrates an exemplary embodiment of a method 400 for securing, and more particularly, locking a barbell assembly 20 constructed in accordance with the present invention to an immovable fixture 410, for example a pole, post, tree, fence, or the like. The method 400 comprises using a sufficient length of an elongate, relatively inelastic tether 415, for example a cable, rope, chain, or the like, to secure the barbell assembly 20 to the immovable fixture 410. Each end of the tether 415 may be provided with a loop 416. The tether 415 is routed (e.g., wrapped) around the immovable fixture 410 and then around and/or through the weight 42 of at least one of the weight subassemblies 40. The other end of the tether 415 is likewise routed through the opening 35 defined by the hook 36, or alternatively, through the opening 135 defined by the hook 136 of the swivel assembly 130B. The loops 416 on the ends of the tether 415 are then interlaced and secured together with a conventional lock 418, such as a combination lock, padlock or the like, in a known manner. As will be readily understood and appreciated by those skilled in the art, the method 400 allows the barbell assembly 20 to be secured to an immovable fixture 410 in at any location, including by way of example an outdoor location, such as an individual's yard, garage, barn, out building, or the like, and thereby protected from theft.

The foregoing detailed description of exemplary embodiments of the invention in conjunction with the accompanying drawing figures has shown and described a barbell assembly having impact absorbing weights that can be used on any exercise or competition surface in any location without damaging the surface in the event that the barbell assembly or one of the weights is dropped onto the surface. In addition, a barbell assembly according to the invention reduces noise and increases the safety of the user during use of the barbell assembly. Importantly, the barbell assembly includes at least one weight subassembly positioned and mounted adjacent each of the opposed ends of the bar. The weight subassembly comprises a weight and an inflatable component that is adapted to be attached to the weight and inflated.

In advantageous embodiments, the weight is a vehicle wheel having a predetermined pattern of through holes, such as a conventional trailer wheel, and the inflatable component is a vehicle tire, such as a conventional trailer tire, mounted on the trailer wheel. The barbell assembly further comprises a flange having at least one predetermined pattern of through holes that corresponds to the predetermined pattern of through holes formed on the vehicle wheel. At least one fastener inserted within the corresponding through holes secures the wheel to the flange. The flange may be affixed to a hub for securing the weight subassembly to the bar, with or without an optional inner sleeve. Alternatively, the flange may be affixed directly to the bar and the wheel of the weight sub assembly secured to the flange by the at least one fastener, as previously described.

In other exemplary embodiments, the barbell assembly further comprises a swivel assembly rotatably attached to at least one outer end of an Olympic bar. The swivel assembly comprises at least a U-shaped hook defining an opening, double-sided barrel bushing and a fastener. The bushing is inserted within a countersink formed in a cap of the outer end and the fastener is tightened to engage the threads of the fastener with the internally-threaded "tapped" end of the grip portion of the Olympic bar disposed within the outer end. As a result, the hook of the swivel assembly is free to rotate relative to both the outer end and the grip portion of the bar.

In other exemplary embodiments, the barbell assembly is utilized to perform a weight pushing exercise without causing damage to the surface on which the exercise is performed. An individual is positioned so as to push the barbell assembly by generating a driving force with his or her legs. Unlike conventional heavily weighted exercise equipment, such as a football sled, the inflatable component adapted to be attached around the periphery of the weight of each weight subassembly allows the barbell assembly to be pushed over the surface without causing damage.

In other exemplary embodiments, the barbell assembly is utilized to perform a weight pulling exercise without causing damage to the surface on which the exercise is performed. An individual is fitted with a harness and a sufficient length of a tether is attached to the harness and to the hook of a swivel assembly at each outer end of the bar. The individual is then positioned so as to pull the barbell assembly by generating a driving force with his or her legs. Unlike conventional heavily weighted exercise equipment, such as a football sled, the inflatable component adapted to be attached around the periphery of the weight of each weight subassembly allows the barbell assembly to be pulled over the surface without causing damage. The swivel assembly at each outer end of the bar allows the outer ends, including the weight subassemblies, to rotate freely relative to the hook of the swivel assembly.

In other exemplary embodiments, the barbell assembly is secured to an immovable fixture, such as a pole, post, tree, fence, or the like, by a sufficient length of a tether having a loop at each end. The tether is routed around the immovable fixture and around and/or through at least one of the weights of the weight subassemblies. The other end of the tether is routed through the opening defined by the stationary hook, or alternatively, the rotatable hook of the swivel assembly. The loops at the ends of the tether are then interlaced and locked together by a conventional lock.

Various exemplary embodiments have been shown and described herein. However, the present invention is not intended to be limited in any manner by the disclosed embodiments. Instead, the scope of the appended claims should be given the broadest reasonable interpretation consistent with the forgoing description and the accompanying drawing figures as understood and appreciated by those having at least ordinary skill in the relevant art.

That which is claimed is:

1. A barbell assembly, comprising:

an elongate bar having opposed ends and defining a longitudinal axis;

a weight subassembly mounted on the bar adjacent each of the opposed ends, each weight subassembly comprising a weight and an inflatable component adapted to be mounted on the weight and inflated, the weight having at least one through hole;

a hub defining an elongate cylinder having at least one through hole for receiving at least one fastener to secure the hub to the bar, the hub comprising a flange having at least one through hole corresponding to the through hole of the weight for attaching the weight subassembly to the hub with another at least one fastener;

a cylindrical inner sleeve configured to be disposed between an inner surface of the hub and an outer surface of the bar, the inner sleeve being made of a deformable material and the at least one fastener securing the hub to the bar by deforming the inner sleeve against the outer surface of the bar; and a swivel assembly on at least one end of the bar, the swivel assembly having a hook adapted to rotate about the longitudinal axis defined by the bar.

2. A barbell assembly according to claim 1, wherein the inflatable component is a vehicle tire composed essentially of rubber.

3. A barbell assembly according to claim 1, wherein the weight is a vehicle wheel and wherein the inflatable component is a vehicle tire that is affixed to the vehicle wheel and inflated.

4. A barbell assembly according to claim 1, wherein the at least one through hole of the weight comprises a plurality of through holes that define a predetermined pattern, and wherein the at least one through hole of the flange comprises at least one plurality of through holes corresponding to the predetermined pattern defined by the plurality of through holes of the weight.

5. A barbell assembly according to claim 1, wherein the hub has a plurality of through holes for receiving a corresponding plurality of the at least one fastener to secure the hub to the bar.

6. A barbell assembly according to claim 1, wherein the hook of the swivel assembly is adapted for supporting the barbell assembly in a generally vertical orientation.

7. A barbell assembly according to claim 1, wherein the swivel assembly further comprises a bushing having a first end configured to be received within a through hole formed in the hook and a second end configured to be received within the end of the bar, and wherein the swivel assembly further comprises a fastener for attaching the hook and the bushing to the end of the bar, while permitting the hook to rotate about the longitudinal axis defined by the bar.

8. A barbell assembly, comprising:

an elongate, essentially rigid bar having opposed ends, the bar defining a longitudinal axis;

a weight mounted on the bar adjacent each of the opposed ends, each weight having at least one through hole;

a hub defining an elongate cylinder having at least one through hole for receiving at least one fastener to secure the hub to the bar, the hub comprising a flange having at least one through hole corresponding to the at least one through hole of the weight;

a cylindrical inner sleeve configured to be disposed between an inner surface of the hub and an outer surface of the bar, the inner sleeve being made of a deformable material and the at least one fastener securing the hub to the bar by deforming the inner sleeve against the outer surface of the bar; and a swivel assembly on at least one end of the bar, the swivel assembly having a hook adapted to rotate about the longitudinal axis defined by the bar;

wherein the weight is attached to the flange of the hub by at least one another fastener received within the at least one through hole of the weight and the at least one through hole of the flange.

9. A barbell assembly according to claim 8, wherein the at least one through hole of the weight comprises a plurality of through holes that define a predetermined pattern, and wherein the at least one through hole of the flange comprises at least one plurality of through holes that correspond to the predetermined pattern defined by the plurality of through holes of the weight.

10. A method for performing a weight pushing exercise utilizing the barbell assembly of claim 1, comprising:

positioning a user relative to the barbell assembly to push the barbell assembly over an exercise surface; and the user generating a driving force to thereby push the barbell assembly over the exercise surface such that the inflatable component of each weight subassembly rolls over and does not damage the exercise surface.

11. A method for performing a weight pulling exercise utilizing the barbell assembly according to claim 1, comprising:

positioning a user relative to the barbell assembly to pull the barbell assembly over an exercise surface;

providing the swivel assembly on each end of the bar;

providing a tether and attaching the tether to the user and to the hook of the swivel assembly on each end of the bar;

the user generating a driving force to thereby pull the barbell assembly over the exercise surface such that the inflatable component of each weight subassembly rolls over and does not damage the exercise surface.

12. A barbell assembly, comprising:

an elongate bar having opposed ends;

a weight mounted on the bar adjacent each of the opposed ends, each weight comprising an inflatable component adapted to be affixed to the weight and inflated, the weight having at least one through hole;

a hub having at least one through hole for receiving at least one fastener to secure the hub to the bar, the hub further having a flange that defines at least one through hole corresponding to the through hole of the weight for attaching the weight to the hub with another at least one fastener; and an inner sleeve made of a deformable material and configured to be disposed between an inner surface of the hub and an outer surface of the bar;

wherein the at least one fastener secures the hub to the bar by deforming the inner sleeve against the outer surface of the bar.

13. A barbell assembly according to claim 12, wherein the inner sleeve is selected from the group consisting of polyethylene, polypropylene and polyvinylchloride pipe.

14. A barbell assembly according to claim 12, wherein the weight is a vehicle wheel and wherein the inflatable component is a vehicle tire that is affixed to the vehicle wheel and inflated.

15. A barbell assembly according to claim 12, wherein the at least one through hole of the weight comprises a plurality of through holes that define a predetermined pattern, and wherein the at least one through hole of the flange comprises a plurality of through holes corresponding to the predetermined pattern defined by the plurality of through holes of the weight.

16. A barbell assembly according to claim 12, wherein the at least one through hole of the hub comprises a plurality of internally-threaded through holes and wherein the at least one fastener comprises a plurality of externally-threaded fasteners to secure the hub to the bar.

17. A barbell assembly according to claim 16, wherein the flange is medially disposed on the hub and wherein the plurality of internally-threaded through holes of the hub are located on opposite lateral sides of the flange.

18. A barbell assembly according to claim 12, wherein the hub defines an elongate annular cylinder and wherein the inner sleeve defines an elongate annular cylinder corresponding to the elongate annular cylinder of the hub.

* * * * *